United States Patent [19]

Holdgaard-Jensen

[11] Patent Number: 4,782,420

[45] Date of Patent: Nov. 1, 1988

[54] SAFETY SWITCH APPARATUS

[76] Inventor: Kurt Holdgaard-Jensen, Dalstroget 6, Silkeborg, Denmark, DK 8600

[21] Appl. No.: 58,454

[22] Filed: Jun. 5, 1987

[51] Int. Cl.[4] ..... H01H 3/34

[52] U.S. Cl. ..... 361/58; 307/140; 307/141.4

[58] Field of Search ..... 361/58, 88, 92, 89, 361/187; 307/125, 126, 130, 131, 140, 141, 141.4; 219/483, 490, 492, 497

[56] References Cited

U.S. PATENT DOCUMENTS 4,031,463 6/1977 Norberg ..... 361/92
4,588,901 5/1986 Maclay ..... 307/141.4

OTHER PUBLICATIONS

Booklet describing features, functions and configurations of a SAB 0529 Programmable Digital Timer, Siemens Aktiengesellschaft, 18 pages, from 1987–1988 Product Catalog (timer originally introduced in 1983–1984 Product Catalog).

*Primary Examiner*—J. R. Scott
*Assistant Examiner*—Derek S. Jennings
*Attorney, Agent, or Firm*—Sheldon & Mak

[57] ABSTRACT

An automatic safety switch apparatus is provided for interrupting power to an electrical appliance such as a cooking stove after a predetermined period of operation. The apparatus includes a current detector for sensing a threshold current level between a power source and the appliance, a timer responsive to the detector, and a relay driven by the timer for opening a circuit between the source and the appliance. The timer, which can be programmed to provide a maximum interval of time during which the appliance can be safely operated unattended, is automatically reset when the appliance is turned off.

22 Claims, 2 Drawing Sheets

SAFETY SWITCH APPARATUS

BACKGROUND

The present invention relates to switches, relays, circuit breakers and the like, and more particularly to means for preventing operation of electrical appliances beyond a predetermined period of time.

A problem for many people is inadvertent failure to turn off an appliance after it is used, resulting in wasted energy and undue wear and tear of the appliance. This is especially true for older people that may be in various stages of senility. Older people also are increasingly susceptible to becoming incapacitated after turning on an appliance. Moreover, certain appliances that consume large amounts of energy, such as stoves, heaters, and irons, are especially hazardous when left on while unattended.

Thus there is a need for a way to limit the period of time that an appliance can be operated unattended. For owners of housing and other facilities that are used by others, it would be impractical to require such limiting means to be a part of each and every dangerous appliance that might be used in the facility. This is because such appliances would be unduly expensive, and policing the requirement would, at least in many cases, involve unreasonable invasions of privacy.

Accordingly, there is a need for a device that automatically interrupts power to an electrical appliance after the appliance has been in operation for a predetermined period of time, that is easy to install and use, and is inexpensive to produce.

SUMMARY

The present invention meets this need by providing an automatic safety switch apparatus for controlling electrical power to an appliance or load, the load being operable between an on condition and an off condition, the apparatus including load current-responsive means for sensing the on condition; means for connecting the power to the load; and means for interrupting the connecting means for substantially removing the power from the load after a predetermined period of time of powered operation of the load. As used herein, substantial removal of the power from the load means limiting electrical current in the load to not more than 1% of a nominal operating current of the load.

Preferably the means for sensing the on condition includes means for applying a voltage to the load for producing a very low trickle current, and means for sensing the trickle current. The trickle current can be less than 1% of a first threshold current associated with the on condition with the power connected to the load, and less than 0.1% of a nominal load current.

The interrupting means can include interrupters for each of two power connections between the source and the load, the trickle means providing a high-resistance electrical path between the source side of one connection and the load side of the other connection, the trickle current sensing means having a voltage input from the load side of the one connection. Preferably the voltage input drives a level detector which feeds a pulse generator for producing a momentary start signal in response to a transition to the on condition. Thus some form of operator intervention is required, in the preferred configuration of the invention, for resumed operation of the appliance after the predetermined maximum safe operating interval has elapsed.

Preferably the apparatus includes means for sensing the off condition whereby the predetermined period of time is reset if the appliance is turned off before the interval has elapsed, as is normally the case. In the typical situation of an alternating-current power source, a current transformer can be connected in a power line to the load for applying a load current-responsive voltage to a transformer sensing circuit, generating a sense signal at a first level when the load current exceeds a second threshold, and a second level when the current is less than the second threshold. The sense signal can feed an off pulse generator for resetting the time period of the interrupting means when the signal goes from the first level to the second level.

The load can be an electrical cooking appliance. The appliance can be remotely located away from the safety switch apparatus in that the on and off conditions of the load are sensed electrically, and operator intervention is not required at the apparatus.

The apparatus can include a housing for the sensing means, the connecting means, and the interrupting means; input means for connecting the power source; and a load socket mounted on the housing for receiving a power plug of the appliance, the load socket being electrically connected to the connecting means. Also, the input means can include a service plug mounted to the housing for both electrical connection to, and mechanical support of the housing by, the service outlet socket, the service plug being electrically connected to the connecting means.

DRAWINGS

These and other features, aspects, and advantages of the present invention will become better understood with reference to the following description, appended claims, and accompanying drawings where:

FIG. 1 an oblique perspective elevational diagram view of apparatus according to the present invention;

DESCRIPTION

Figure 1:
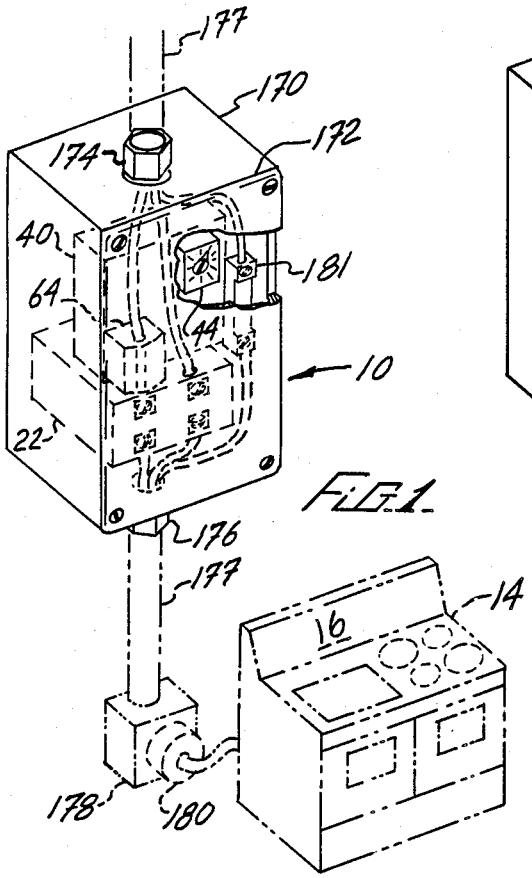
Figure 2:
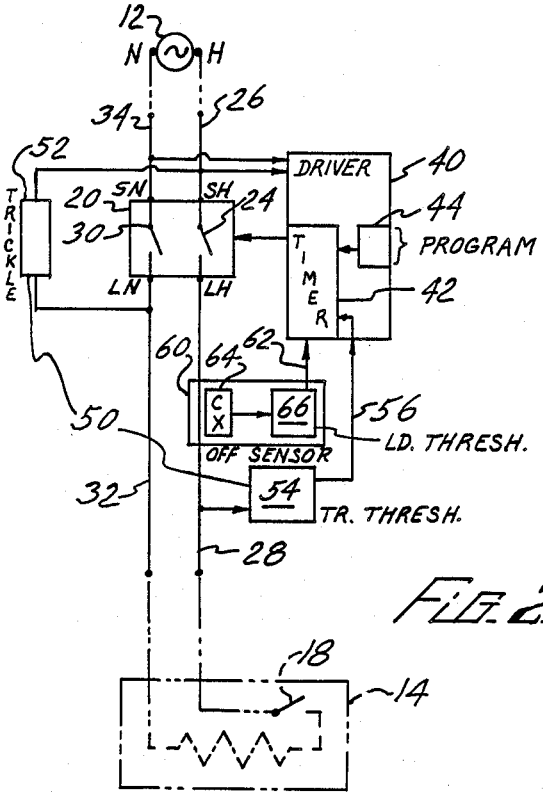
FIG. 2 is a schematic block diagram of the apparatus of FIG. 1.

The present invention is directed to an automatic safety switch apparatus that cuts off power to an electrical appliance after the appliance has been in operation for a predetermined maximum safe period of time. With reference to the drawings, particularly FIGS. 1–4, a safety switch apparatus 10 is connected between a source 12 of alternating current power, typically at 220V, 50 Hz or 60 Hz, and an appliance or load 14 such as a cooking stove 16. The load 14 is operable between an on condition wherein the load carries at least a first threshold current magnitude when the power is applied, and an off condition wherein the load carries less than the threshold current when the power is applied. As shown in FIG. 2, the on and off conditions of the load 14 are typically controlled by load switch means 18 associated with the load 14.

The apparatus 10 includes a connector means 20, typically in the form of a two-pole relay 22, the relay 22 being connected between the source 12 and the load 14 for selectively connecting the power thereto during a predetermined safe-operation period of time for the load 14 as further described herein. A first pole 24 of the relay 22 has an SH terminal for connection to a high side of the source 12 by a source feed line 26, and an SL terminal for connection to the load 14 by a load feed line 28. Similarly, a second pole 30 of the relay 22 has an LN terminal for connection to the load 14 by a load return line 32, and an SN terminal for connection to a neutral side of the source 12 by a source return line 34.

A driver circuit 40 operates the relay 22 between an active condition wherein the first and second poles 24 and 30 are closed for transmitting the power to the load 14, and an inactive condition wherein the poles 24 and 30 are open for interrupting the power to the load. For this purpose, the driver circuit 40 includes a timer 42, the timer 42 having an associated program switch means 44 for selecting an appropriate time delay magnitude corresponding to a predetermined maximum period of time for continued operation of the load 14 without operator intervention.

An important feature of the present invention is that the load 14 is monitored by an on sensor means 50 for determining the on condition with substantially no power applied to the load 14. The on sensor means 50 includes a trickle means 52 for applying, through a high-resistance path, an electrical voltage to the load 14 and a corresponding trickle current therein when the relay 22 is interrupting the power and the load 14 is in the on condition. In a preferred configuration, the trickle means 52 is connected between the SH terminal of the first pole 24 and the LN terminal of the second pole 30 of the relay 22. The resistance of the trickle means 52 is chosen such that the trickle current is always much less than the operating current of the load. The on detector means 50 also includes a trickle threshold circuit 54 for sensing the trickle current and providing a start signal 56 to the driver circuit 40 for operating the relay 22 whereby the power is connected to the load 14. Preferably the trickle current is very much less than a minimum operating current of the load. For example, the connection of the trickle means 52 described above advantageously permits reliable detection of the on condition of the load after power interruption with the trickle current limited to less than 1 mA through a load 14 that consumes at least 0.4 A and commonly consumes 10 A or more.

The apparatus 10 also includes an off sensor means 60 for providing a reset signal 62 when the current in the load 14 falls below a second threshold current magnitude. The off sensor means 60 has, coupled to the load feed line 28, a current transformer 64 for producing a signal in response to current flowing in the load feed line 28. The current transformer 64 drives a load threshold circuit 66 for producing the reset signal 62 as a momentary pulse when the signal from the current transformer 64 falls below a level corresponding to the second threshold current. A device suitable for use as the current transformer 64 is available from Jenkaelectronic A.S. of Oslo, Norway, designated "Kohsel 3-12 Kerne 3-12, Prim. 1×2, 5ϕ 1 KV isol.—sec. 2,500×0, 1ϕ 380V isol."

Figure 4:
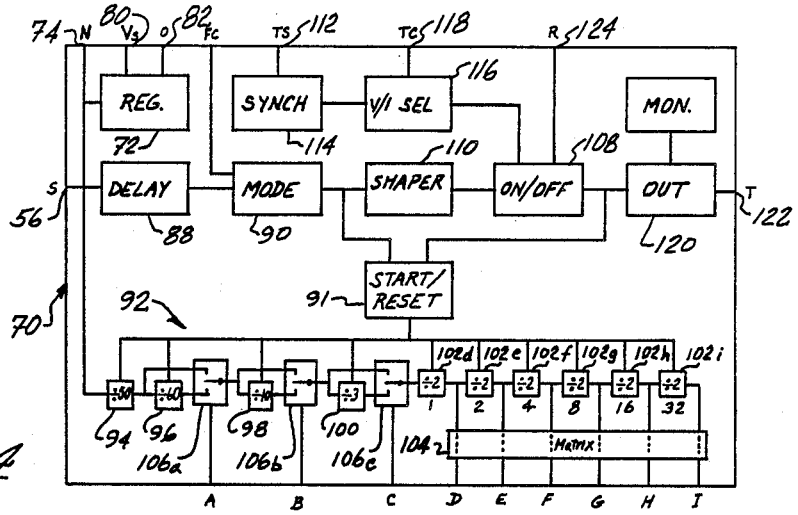
FIG. 4 is a block diagram showing details of the apparatus of FIG. 1 within region 4 of FIG. 3.
Figure 3:
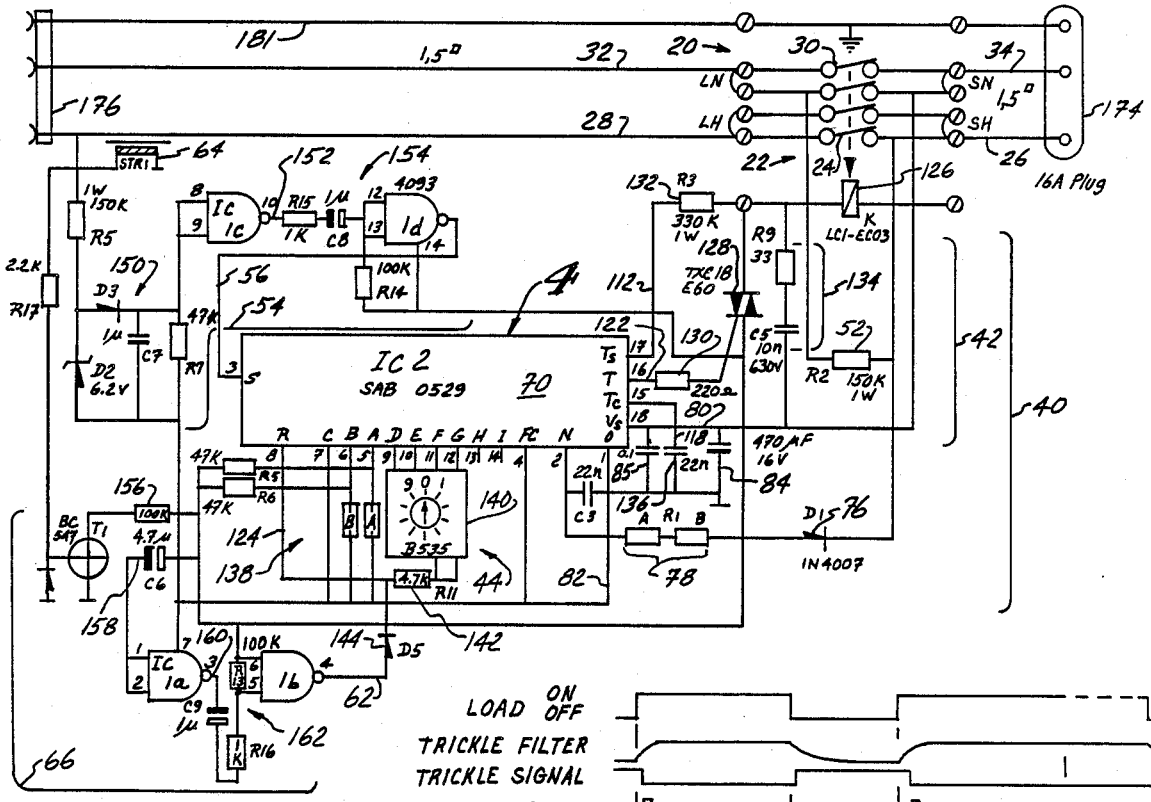
FIG. 3 is a schematic circuit diagram of the apparatus of FIG. 1.

As best shown in FIGS. 3 and 4, an exemplary configuration of the timer 42 includes an integrated circuit timer module 70. A suitable device for use as the timer module 70 in the present invention is an SAB 0529, available from Siemens Corp., of Sunnyvale, CA. The timer module 70 includes a supply regulator 72 having an unregulated power input 74 that is fed from SH through a rectifier diode 76 and a dropping resistance 78; a logic supply connection 80 to SN, and a logic ground 82 that is regulated by the regulator 72 to about 6 volts below SN during negative swings of SH. Ripple capacitors 84 and 85 smooth the voltage between the logic ground 82 and the supply connection 80, and a bypass capacitor 86 filters high frequency noise at the power input 74. Appropriate power connections are also made from the supply connection 80 and the logic ground 82 to the trickle threshold circuit 54 and the off sensor means 60.

The timer module 70 includes a delay module 88 for receiving the start signal 56 from the trickle threshold circuit 54. The delay module 88 drives a mode switching circuit 90 (not relevant to the present invention), the mode switching circuit 90 setting a start/reset block 91 to a start condition for enabling a programmable divider chain or counter 92. The counter 92 includes a Herz divider 94 operatively connected to the power input 74 for counting at a line frequency of the source 12. The output of the Herz divider 94 is intended to be run at one cycle per second. Accordingly, when the source frequency is 50 Hz, the Herz divider 94 is provided as a divide by 50 circuit, as shown in FIG. 4. Of course, when operation in a 60 Hz environment is contemplated, the Herz divider 94 would be a divide by 60 circuit. The Herz divider 94 drives, in turn, a seconds divider 96, a tens divider 98, a tertiary divider 100, and a plurality of binary dividers 102, designated 102D, 102E, 102F, 102G, 102H, and 102I. A mask-programmable matrix 104 is connected between the binary dividers 102 and respective external connections D, E, F, G, H, and I of the timer module 70. Additional external connections A, B, and C are provided for setting corresponding range-selector 106, designated **106*a*, 106*b*, and 106*c*. The range selectors 106*a* is interposed between the seconds divider and the tens divider 98 for selecting between minute intervals and second intervals. Similarly, the range selector 106*b* selects between intervals of single minutes or seconds and tens or minutes or seconds. The range selector 106*c*** changes the time interval by a factor of 3.

The mode selector circuit 90 also drives an on/off module 108 through a pulse shaper 110 to an on state for enabling a train of trigger pulses. The trigger pulses are derived from an external trigger source 112 that drives a synch detector 114 of the timer module 70. The synch detector 114 drives the on/off module 108 through a voltage/current synch selector 116 whereby the trigger pulses are produced at zero crossings of the trigger source 112, the zero crossings being selectively voltage or current zero crossings, depending on an external trigger connection 118 to the selector 116. When the on/off module 108 is in the on state, the trigger pulses are passed therethrough to an output module 120 which provides a trigger output 122 for driving an output device such as an SCR or a triac. The on/off module 108 is also provided with an external reset connection 124 for terminating the on state of the on/off module 108 and resetting the start/reset block 91.

In the apparatus of the present invention, a coil 126 of the relay 22 is connected through a triac 128 to the supply connection 80, and SN as described above. A gate resistor 130 is appropriately connected between the triac 128 and the trigger output 122 of the timer module 70. Also, a source resistor 132 is connected between the coil 126 at the triac 128 to the trigger connection 128 of the timer module 70. Further, a noise filter 134 is provided in parallel with the triac 128 for suppressing electrical noise from the triac 128. Moreover, a trigger capacitor 126 is connected between the logic ground 82 and the trigger connection 118 for appropriately configuring the voltage/current synch selector 116. Thus, when the on/off module 108 is in the on state, the output module 120 triggers the triac 128 through the gate resistor 130 for activating the coil 126, closing the first and second poles 24 and 30 of the relay 22, thereby connecting the power source 12 through the relay 22 to the load 14.

The timer module 70 is programmed by providing selected high and low voltages to the selector connections A, B, and C for the range selectors 106*a–c*, and by providing selected (programmed) circuit connections between the connections D-I to the reset connection 124. For programming the predetermined period of time during which the load 14 can be operated, a jumper network 138 is provided between the range selector connections A-C of the timer module 70, the logic ground 82, and the supply connection 80. Also, a decade switch 140 is provided between the connections D-G of the timer module 70 and a timeout resister 142, the timeout resistor 142 being connected to the reset connection 124 of the timer module 70, and to the reset signal 62 through an isolating diode 144. At the end of a predetermined period of time from the occurrence of the start signal 56, programmed as described above, an impulse is driven from the decade switch 140 through the timeout resistor 142 to the reset connection 124 of the timer module 70, thus terminating the triggering of the triac 128, deactivating the coil 126 of the relay 22, thereby interrupting the connection between the power source 12 and the load 14.

The start signal 56 is produced by the trickle threshold circuit 54 in response to a trickle current through the load 14 when the relay 22 is de-energized, a resistor R2 providing the trickle means 52 between SH of the first pole 24 and LN of the second pole 30 of the relay 22, the trickle current also flowing to the load 14 in the load return line 32 and from the load in the source return line 34, and in a trickle sense resistor R5 of the trickle threshold circuit 54. In a typical case of the power source 12 having 220 volt potential, the resistors R2 and R5 can each be valued at 150K ohms. If the load 14 also has an equivalent resistance of 50K ohms, the trickle current will amount to about 0.7 mA. The resistor R5 charges a zener-regulated rectifying filter circuit 150, the filter circuit 150 being connected to a Schmitt trigger element, designated IC—1*c* in FIG. 3, the trigger circuit IC—1*c* producing a trickle signal 152. The trickle signal 152 has a first high level when the load is in the off condition with the power interrupted by the open condition of the relay 22. When the relay is closed, the trickle current causes a second level of the trickle signal 152. The trickle signal 152 drives a trickle pulse generator 154 for producing the start signal 56 when the trickle signal 152 goes from the first level to the second level.

As shown in further detail in FIG. 3, the current transformer 64 of the off sensor means 60 drives a grounded-emitter NPN transistor T1 through a limiting resistor R12, the transistor T1 having an associated grounded base diode D4 for preventing excessive reverse bias. The collector of the transistor T1 is connected through a collector resistor 156 to the supply connection 80 for loading the collector positively when the current transformer 64 is not driving the transistor T1. A capacitor 158 is connected across the collector resistor 156 for blocking high frequency noise at the collector. The collector of the transistor T1 is also connected to a Schmitt trigger circuit, designated IC-1*a*, the trigger circuit IC-1*a* producing a transformer sense signal 160. When the current in the load 14 is equal to or greater than about 0.4A, the transistor T1 becomes forward-biased, maintaining a low voltage level at the trigger circuit IC-1*a* and producing a first high level of the transformer sense signal 160.

The transformer sense signal 160 is connected to an off pulse generator 162 for producing the reset signal 62 when the transformer sense signal 160 goes from the first level corresponding to a threshold load current magnitude equal to or exceeding 0.4A to a second level corresponding to a load current of smaller magnitude. Thus the reset connection 124 is driven by the reset signal 62 in the event that the load 14 is turned off before the end of the programmed predetermined period of time.

The Schmitt trigger circuits, including the four circuit elements IC-1*a*, IC-1*b*, IC-1*c*, and IC-1*d*, can be combined in a single integrated circuit such as the generally known quad NAND Schmitt trigger 4093 that is available from a number of suppliers.

The apparatus 10 of the present invention is preferably provided with a housing 170 for supporting and protecting the connector means 20, the driver circuit 40, the on sensor means 50, and the off sensor means 60. Preferably the housing 170 has a cover 172 for providing access to the program switch means 44. The housing 170 is provided with input termination means 174 for connection to the power source 12, and output termination means 176 for connection to the load 14. As shown in FIG. 1, the input termination means 174 and the output termination means 176 can be adapted for receiving electrical conduits 177 whereby the apparatus 10 is permanently installed in or on the wall of a building. In this configuration, the load 14 can be connected to the apparatus 10 by means of a load socket 178, the load socket 178 being located remotely from the housing 170. A power plug 180, associated with the load 14, electrically connects the load 14 to the apparatus 10 by engaging the load socket 178. A ground circuit 181, shown in FIG. 3, connects the housing 170 and a corresponding connection of the load socket in a conventional manner. Typically the conduits 177 are conductive, being included in the ground circuit 181.

Figure 5:
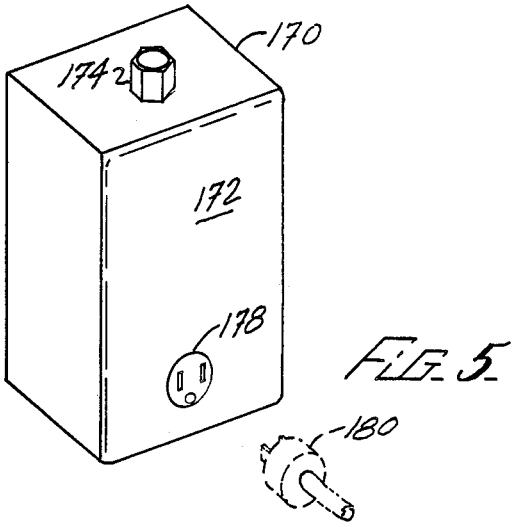
FIG. 5 is an oblique perspective view showing an alternative configuration of the apparatus of FIG. 1.

In an alternative configuration of the present invention shown in FIG. 5, the load socket 178 is provided integrally with the housing 170 for direct connection of the power plug 180 of the load 14 to the apparatus 10.

Figure 6:
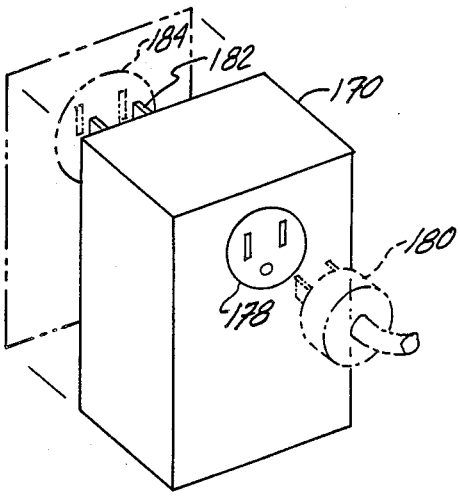
FIG. 6 is an oblique perspective view showing another alternative configuration of the apparatus of FIG. 1.

In a further alternative configuration of the present invention shown in FIG. 6., the input termination means 174 can include a service plug 182 mounted to the housing 170 for connection to an existing service outlet socket 184.

Figure 7:
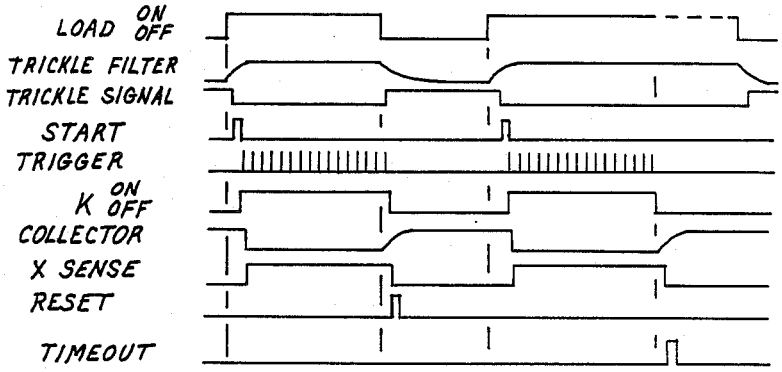
FIG. 7 is a timing diagram for the apparatus of FIG. 1.

The operating sequence of the apparatus 10 is best understood with further reference to the timing diagram of FIG. 7. The designation "load on/off" represents occurrences of the on condition and the off condition of the load 14, as controlled by the load switch means 18. "Trickle filter" represents the voltage from the zener-regulated rectifying filter 150; "trickle signal" represents the voltage of the trickle signal 152; "start" represents the start signal 56; "trigger" represents the trigger output 122 of the timer module 70; "K on/off" represents the state of the coil 126 of the relay 22; "X sense" represents the transformer sense signal 160; "collector" represents the collector voltage of the transistor T1; "reset" represents the reset signal 62; and "timeout" represents the connection between the decade switch 140 and the timeout resistor 142.

In operation, when the load switch means 18 is turned on, producing the on condition of the load 14, the trickle filter 150 rises exponentially until it is clipped by the zener regulation of the rectifying filter 150. When the threshold of the Schmitt trigger IC-1*c* is exceeded, the trickle signal 152 goes low, producing the start pulse 56 from the trickle pulse generator 154, thereby starting the timer module 70. After a short delay, the trigger pulses appear at the trigger output 122, causing the relay 22 to be turned on by the triac 128. This process of connecting the power 12 to the load 14 normally occurs within a time period of about 0.25 second or less. This delay is normally not detrimental to the operation of the load 14.

As a result of the power applied to the load 14, transistor T1 is turned on by the current transformer 64, driving its collector low. If the load 14 is turned off by the load switch means 18 before the end of the predetermined timer setting as shown in the left side of FIG. 7, the collector voltage of the transistor T1 rises exponentially in response to termination of output from the current transformer 64. When the collector rises above the trigger threshold of IC-1*a*, the transformer sense signal 160 goes low, producing from the reset pulse generator 162 a pulse reset signal 62, resetting the timer module 70, thereby disconnecting the power from the load 14.

If the load 14 remains in the on condition longer than the programmed period of time as shown in the right side of FIG. 7, a pulse is transmitted from the decade switch 140 through the timeout resistor 142 to the reset connection 124, similarly resetting the timer module 70, thereby cutting off power from the load 14. The trickle filter output remains high, however, because of the resumption of the trickle current through the load, until the load switch means 18 is opened by operator intervention. At this point, the trickle filter goes low, enabling a subsequent start pulse upon a second engagement of the load switch means 18.

Although the present invention has been described in considerable detail with reference to certain preferred versions thereof, other versions are possible. For example, the source 12 and the load 14 can have a three-phase or other polyphase configuration, as long as the relay 22 has sufficient poles for interrupting the current in each phase while permitting the trickle current in at least one phase. Also, when the load 14 is a low-power device, the load threshold can be made much smaller than 0.4A by appropriate design of the current transformer 64 and the load threshold circuit 66. Moreover, the rectifying filter 150 can be connected to indicating means for remotely showing the on and off conditions of the load 14. Therefore, the spirit and scope of the appended claims should not necessarily be limited to the description of the preferred versions contained herein.

What is claimed is:

1. An apparatus for controlling power to an electrical load, the load being operable between an on condition wherein the load carries at least a first threshold current magnitude when the power is applied, and an off condition wherein the load carries less than a second threshold current when the power is applied, the apparatus comprising:

(a) on sensing means for sensing the on condition of the load in response to current in the load;

(b) means for connecting the power to the load; and (c) means for interrupting the connecting means, the interrupting means substantially removing the power from the load when the power is applied for the duration of a predetermined period of time after occurrence of the on condition, wherein the on sensing means comprises means for detecting a trickle current magnitude in the load when the connecting means is interrupted by the interrupting means.

2. The apparatus of claim 1 wherein the on sensing means comprises:

(a) trickle means for applying an electrical voltage to the load whereby a trickle current is produced in the load when the load is in the on condition, the trickle current being much less than the first threshold current; and (b) means for sensing the trickle current.

3. The apparatus of claim 2 wherein the trickle current is less than about 1% of the first threshold current.

4. The apparatus of claim 3 wherein the load carries a nominal load current with power applied in the on condition and the trickle current is less than about 0.1% of the nominal load current.

5. The apparatus of claim 2 wherein the power source has a first connection and a second connection, the interrupting means comprises means for disconnecting a first connection of the load from the first connection of the source and disconnecting a second connection of the load from the second connection of the source, the trickle means comprises a high-resistance electrical path between the first connection of the source and the low connection of the load, and the means for sensing the trickle current comprises means for sensing a voltage at the first connection of the load.

6. The apparatus of claim 1 wherein, following an interruption of power to the load by the interrupting means, the on sensing means is effective only after occurrence of the off condition of the load.

7. The apparatus of claim 6 wherein the on sensing means further comprises:

(a) trickle means for applying an electrical voltage to the load whereby a trickle current is produced in the load when the load is in the on condition, the trickle current being much less than the first threshold current;

(b) a trickle sensing circuit responsive to the trickle current for producing a trickle sense signal, the trickle sense signal having a first level when the load is in the off condition with the power interrupted by the interrupting means, and at least a second level when the load is either in the on condition or the power is applied to the load; and (c) on pulse means for producing a momentary start signal when the trickle sense signal moves from the first level to the second level.

8. The apparatus of claim 6 wherein the connecting means is responsive to the on sensing means, whereby, after the connecting means is interrupted by the interrupting means, the power is reconnected to the load upon a second occurrence of the on condition.

9. The apparatus of claim 1 further comprising off sensing means for determining the off condition of the load in response to a change in current in the load.

10. The apparatus of claim 9 further comprising means responsive to the off sensing means for resetting the interrupting means whereby, when the load is returned to the off condition while the power is applied to the load, a new predetermined period of time of the interrupting means commences upon a second occurrence of the on condition.

11. The apparatus of claim 9 wherein the load is driven from a source of alternating current having a source frequency, and the off sensing means comprises:

(a) a current transformer operatively coupled for producing a transformer voltage in response to current flowing between the source and the load, the transformer voltage being indicative of the magnitude of the load current; and (b) a transformer sensing circuit for receiving the transformer voltage and producing a transformer sense signal, the transformer sense signal having a first level when the load current exceeds the second threshold current, and a second level when the load current is less than the second threshold current.

12. The apparatus of claim 11 further comprising off pulse means for resetting the interrupting means when the transformer sense signal moves from the first level to the second level.

13. The apparatus of claim 1 wherein the load comprises an electrical cooking appliance.

14. The apparatus of claim 1 wherein the apparatus is remotely located from the load.

15. The apparatus of claim 1 wherein the load has an associated power plug for receiving electrical power, the apparatus further comprising:

(a) a housing for the sensing means, the connecting means, and the interrupting means;

(b) means for connecting the power source from outside the housing to the connecting means; and (c) a load socket mounted to the housing for receiving the power plug, the load socket being electrically connected to the connecting means.

16. The apparatus of claim 15 wherein the power source is applied to a service outlet socket, and the means for connecting the power source comprises a service plug mounted to the housing for both electrical connection to the service outlet socket and mechanical support of the housing by the service outlet socket, the service plug being electrically connected to the interrupting means.

17. An apparatus for controlling power to a remotely located electrical cooking appliance from a source of alternating current having a high connection and neutral connection and operating at a source frequency, the appliance having a high connection and a neutral connection and being operable between an on condition wherein the appliance carries a nominal load current with power applied in the on condition, the load current having at least a first threshold current magnitude, and an off condition wherein the appliance carries less than a second threshold current when the power is applied, the apparatus comprising:

(a) a housing;

(b) on sensing means in the housing for sensing the on condition of the appliance, comprising:

(i) trickle means for applying an electrical voltage to the load whereby a trickle current is produced in the load when the load is in the on condition, the trickle current being less than about 1% of the first threshold current and less than about 0.1% of the nominal load current, the trickle means comprising a high-resistance electrical path between the high connection of the source and the low connection of the load; and (ii) means for sensing the trickle current comprising means for sensing a voltage at the high connection of the load;

(c) means in the housing for connecting the power to the load, the connecting means being responsive to the on sensing means; and (d) means in the housing for interrupting the connecting means, the interrupting means comprising means for disconnecting the high connection of the load from the high connection of the source and disconnecting the neutral connection of the load from the neutral connection of the source for substantially removing the power from the load when the power is applied for the duration of a predetermined period of time after occurrence of the on condition, whereby, after the connecting means is interrupted by the interrupting means, the power is reconnected to the load upon a second occurrence of the on condition.

18. An apparatus for controlling power to an electrical load, the load being operable between an on condition wherein the load carries at least a first threshold current magnitude when the power is applied, and an off condition wherein the load carries less than a second threshold current when the power is applied, the apparatus comprising:

(a) on sensing means for sensing the on condition of the load in response to current in the load;

(b) means for connecting the power to the load;

(c) means for interrupting the connecting means, the interrupting means substantially removing the power from the load when the power is applied for the duration of a predetermined period of time after occurrence of the on condition, wherein, following an interruption of power to the load by the interrupting means, the on sensing means is effective only after occurrence of the off condition of the load.

19. The apparatus of claim 18 wherein the connecting means is responsive to the on sensing means, whereby, after the connecting means is interrupted by the interrupting means, the power is reconnected to the load upon a second occurrence of the on condition.

20. An apparatus for controlling power to an electrical load, the load being operable between an on condition wherein the load carries at least a first threshold current magnitude when the power is applied, and an off condition wherein the load carries less than a second threshold current when the power is applied, the apparatus comprising:

(a) on sensing means for sensing the on condition of the load in response to current in the load;

(b) means for connecting the power to the load;

(c) means for interrupting the connecting means, the interrupting means substantially removing the power from the load when the power is applied for the duration of a predetermined period of time after occurrence of the on condition;

(d) off sensing means for determining the off condition of the load in response to a change in current in the load; and (e) means responsive to the off sensing means for resetting the interrupting means whereby, when the load is returned to the off condition while the power is applied to the load, a new predetermined period of time of the interrupting means commences upon a second occurrence of the on condition.

21. An apparatus for controlling power to an electrical load from a source of alternating current having a source frequency, the load being operable between an on condition wherein the load carries at least a first threshold current magnitude when the power is applied, and an off condition wherein the load carries less than a second threshold current when the power is applied, the apparatus comprising:

(a) on sensing means for sensing the on condition of the load in response to current in the load;

(b) means for connecting the power to the load;

(c) means for interrupting the connecting means, the interrupting means substantially removing the power from the load when the power is applied for the duration of a predetermined period of time after occurrence of the on condition; and (d) off sensing means for determining the off condition of the load in response to a change in current in the load, comprising:

(i) a current transformer operatively coupled for producing a transformer voltage in response to current flowing between the source and the load, the transformer voltage being indicative of the magnitude of the load current; and (ii) a transformer sensing circuit for receiving the transformer voltage and producing a transformer sense signal, the transformer sense signal having a first level when the load current exceeds the second threshold current, and a second level when the load current is less than the second threshold current.

22. The apparatus of claim 21 further comprising off pulse means for resetting the interrupting means when the transformer sense signal moves from the first level to the second level.

* * * * *